US010006251B2

(12) United States Patent
Nakamura et al.

(10) Patent No.: US 10,006,251 B2
(45) Date of Patent: Jun. 26, 2018

(54) DIGGING BIT

(71) Applicant: MITSUBISHI MATERIALS CORPORATION, Tokyo (JP)

(72) Inventors: Kazuyoshi Nakamura, Anpachi-gun (JP); Hiroshi Ota, Anpachi-gun (JP)

(73) Assignee: MITSUBISHI MATERIALS CORPROATION, Tokyo (JP)

( * ) Notice: Subject to any disclaimer, the term of this patent is extended or adjusted under 35 U.S.C. 154(b) by 338 days.

(21) Appl. No.: 14/771,634

(22) PCT Filed: Mar. 3, 2014

(86) PCT No.: PCT/JP2014/055313

§ 371 (c)(1),
(2) Date: Aug. 31, 2015

(87) PCT Pub. No.: WO2014/136727

PCT Pub. Date: Sep. 12, 2014

(65) Prior Publication Data

US 2016/0002979 A1 Jan. 7, 2016

(30) Foreign Application Priority Data

Mar. 5, 2013 (JP) ..... 2013-043549
Feb. 6, 2014 (JP) ..... 2014-021674

(51) Int. Cl.
*E21B 10/26* (2006.01)
*E21B 10/38* (2006.01)
*E21B 10/60* (2006.01)

(52) U.S. Cl.
CPC ..... *E21B 10/26* (2013.01); *E21B 10/38* (2013.01); *E21B 10/60* (2013.01)

(58) Field of Classification Search
CPC ..... E21B 10/26; E21B 10/38; E21B 10/60; E21B 10/36; E21B 10/43; E21B 10/42
See application file for complete search history.

(56) References Cited

U.S. PATENT DOCUMENTS 4,883,132 A 11/1989 Tibbitts
6,039,127 A * 3/2000 Myers ..... E21B 10/38 175/425

(Continued)

FOREIGN PATENT DOCUMENTS

AT 370206 B 3/1983
CN 2758440 Y 2/2006

(Continued)

OTHER PUBLICATIONS

International Search Report dated Jun. 3, 2014, issued for PCT/JP2014/055313 and English translation thereof.

(Continued)

*Primary Examiner* — Yong-Suk Ro
(74) *Attorney, Agent, or Firm* — Locke Lord LLP

(57) ABSTRACT

A digging bit includes a reaming portion whose diameter is larger than a rear end portion of a bit body, and which is formed in a front end portion of the bit body rotated around an axis, a digging tip which is arranged in a front end portion of the reaming portion, a debris groove which extends in a direction of an axis, and which is formed in an outer peripheral portion of the reaming portion, and a communication groove which communicates with the debris groove, and which is formed from the outer peripheral portion to a rear end portion of the reaming portion.

12 Claims, 11 Drawing Sheets

(56) References Cited

U.S. PATENT DOCUMENTS

| | | | | |
|---|---|---|---|---|
| 6,568,492 | B2 * | 5/2003 | Thigpen | E21B 10/43 175/408 |
| 2001/0018990 | A1 | 9/2001 | Asberg et al. | |
| 2012/0061146 | A1 | 3/2012 | Pearce et al. | |

FOREIGN PATENT DOCUMENTS

| | | | |
|---|---|---|---|
| CN | 202645432 | U | 1/2013 |
| EP | 1811125 | A1 | 7/2007 |
| JP | 38-000606 | Y | 1/1963 |
| JP | 2008-174968 | A | 7/2008 |
| JP | 4709226 | B2 | 6/2011 |

OTHER PUBLICATIONS

Supplementary European Search Report dated Oct. 25, 2016, issued for the European patent application No. 14760641.2.
Office Action dated Jul. 5, 2016, issued for the Chinese patent application No. 201480011182.0 and English translation thereof.

* cited by examiner

DIGGING BIT

TECHNICAL FIELD

The present invention relates to a digging bit in which a digging tip is arranged in a front end portion of a bit body rotated around an axis so as to form a borehole in rocks.

Priority is claimed on Japanese Patent Application No. 2013-043549, filed Mar. 5, 2013, and Japanese Patent Application No. 2014-021674, filed Feb. 6, 2014, the content of which is incorporated herein by reference.

BACKGROUND ART OF THE INVENTION

When digging work is carried out using this digging bit, a bit body is recovered by being pulled out from a borehole after the borehole is formed to reach a predetermined depth. However, if the borehole is formed in rocks which are likely to collapse, a wall in the borehole may collapse, and a rear end side of the bit body may be covered with debris. Consequently, in some cases, the bit body cannot be removed from the borehole. Therefore, as disclosed in PTL 1 for example, a retractable bit in which a cutting blade is disposed in a rear end portion of the bit body is used in this case.

CITATION LIST

Patent Document

Patent Document 1: Japanese Patent No. 4709226

DETAILED DESCRIPTION OF THE INVENTION

Problems to be Solved by the Invention

Here, this retractable bit generally employs a configuration in which a rear end portion of a bit body functions as a cylindrical skirt portion and a front end portion of the bit body functions as a reaming portion which has a larger diameter than a front end side portion of the skirt portion. A digging tip for digging a borehole in rocks is arranged on a front end surface of this reaming portion. A debris groove for causing debris generated from rocks crushed by the digging tip when the borehole is formed to be fed rearward from the reaming portion is formed in an outer periphery of the reaming portion.

Furthermore, a large diameter portion whose diameter increases toward the further outer peripheral side from the front end side portion of the skirt portion is formed in the rear end portion of the skirt portion. Then, a concave portion is formed in the large diameter portion so as to be recessed from the rear end surface to the front end side of the skirt portion. The above-described cutting blade is formed in an intersecting ridgeline portion between the concave portion and the rear end surface of the skirt portion. In addition, a groove which extends from the concave portion to the front end side in the axial direction is formed in the outer periphery of the large diameter portion. This groove communicates with the above-described debris groove in the front end of the skirt portion. Debris is fed rearward from the reaming portion are discharged through the debris groove.

However, although the groove is formed in the large diameter portion in the rear end of the skirt portion in this way, as compared to a general digging bit in which the skirt portion entirely has a smaller diameter than the reaming portion, this type of retractable bit cannot avoid a case where performance for discharging debris becomes poor due to the large diameter portion, thereby causing a possibility that digging resistance may increase when a borehole is formed. In addition, when the bit body is pulled out from the borehole, there is also a possibility that a portion between the large diameter portion and a hole wall may be filled with debris. If the debris remains in a portion between the large diameter portion and the reaming portion within the skirt portion, it is difficult to efficiently discharge the remaining debris through the debris groove to the front end side of the bit body. Consequently, there is a possibility that the bit body cannot be recovered.

The present invention is made in view of these circumstances, and an object thereof is to provide a digging bit in which performance for discharging debris does not become poor when a borehole is formed, and in which a bit body can be recovered by being reliably and efficiently pulled out from the borehole after the borehole is formed to reach a predetermined depth.

Solution to Problem

In order to achieve the object by solving the problems, according to an aspect of the present invention, there is provided a digging bit for forming a borehole in rocks, including: a reaming portion whose diameter is larger than a rear end portion of a bit body, and which is formed in a front end portion of the bit body rotated around an axis; a digging tip which is arranged in a front end portion of the reaming portion; a debris groove which extends in the axial direction, and which is formed in an outer peripheral portion of the reaming portion; and a communication groove which communicates with the debris groove, and which is formed from the outer peripheral portion to a rear end portion of the reaming portion.

In this digging bit, the rear end portion of the bit body has a smaller diameter than the large diameter reaming portion formed in the front end portion. Accordingly, debris fed rearward from the reaming portion can be smoothly discharged through the debris groove, along with preventing performance for discharging debris from becoming poor. Therefore, it is possible to reduce digging resistance. In addition, when the bit body is pulled out from a borehole, it is possible to prevent a portion between the rear end portion of the bit body and a hole wall from being filled with the debris.

Then, the communication groove which communicates with the debris groove is formed from the outer peripheral portion to the rear end portion of the reaming portion. Accordingly, if the bit body is moved rearward when being pulled out from the borehole, the debris which remain in the outer periphery of the rear end portion of the bit body are fed into the debris groove via the communication groove. Therefore, even when the borehole is formed in rocks which are likely to collapse, the debris generated due to collapse can be efficiently discharged to the front end side of the bit body. Therefore, the bit body can be reliably pulled out and recovered.

Here, when the rear end portion of the bit body generally functions as the cylindrical skirt portion as described above, a male screw in a front end of a digging rod is screwed into a female screw formed in an inner periphery thereof, and the bit body is rotated during digging. Therefore, in a case where the bit body is pulled out while being rotated in the same direction as the rotating direction during digging, particularly when the bit body is pulled out from the borehole, an intersecting ridgeline located on the rear side in the rotating direction of the bit body at least during digging within the intersecting ridgelines between the communication groove and the rear end surface of the reaming portion may be located on a plane parallel to the axis or on a plane including the axis. The rotation of the bit body enables debris to be taken along a groove wall in the communication groove connected to the intersecting ridgeline, and to be guided to the debris groove.

In this case, when the bit body is pulled out and recovered from the borehole by causing the width of the communication groove to be larger than the width of the debris groove in the circumferential direction of the bit body, a lot of debris around the rear end portion of the bit body is received by the communication groove and fed into the debris groove to discharge the debris to the front end side of the bit body. For example, when the multiple debris grooves are formed in the outer peripheral portion of the reaming portion at intervals in the circumferential direction, the communication groove is formed so as to communicate with the multiple debris grooves which are adjacent to each other in the circumferential direction. In this manner, a lot of debris fed into the communication groove can be dispersed and fed to the multiple debris grooves, and can be more efficiently discharged.

Furthermore, the communication groove is configured so that the groove depth thereof gradually becomes deeper from the rear end surface of the reaming portion toward the rear side in the rotating direction of the bit body during digging. In this manner, when the bit body is pulled out while being rotated in the rotating direction during digging, a lot of debris can be accommodated in a deep portion of the groove, and discharging can be efficiently promoted.

In contrast, the communication groove may be formed so as to extend in a direction tilting to the axis. In this manner, particularly even when the bit body is pulled out from the borehole without being rotated, the debris remaining in the outer periphery of the rear end portion of the bit body is guided along the tilted communication groove, and is fed into the debris groove. Therefore, without rotating the bit body, the debris remaining in the outer periphery of the rear end portion of the bit body can be efficiently discharged to the front end side of the bit body. Accordingly, the bit body can also be reliably recovered.

In addition, when the communication groove is formed so as to tilt in this way, the communication groove tilts toward the front end side in the axial direction so as to be oriented in the rotating direction of the bit body during digging. In this manner, even when the bit body is pulled out as described above, the bit body is rotated in the rotating direction during digging. Accordingly, the rotation of the bit body also enables the debris to be guided from the communication groove to the debris groove. Therefore, debris discharging can be more efficiently promoted.

When the communication groove is formed so as to tilt as described above, it is desirable to set a tilting angle thereof, that is, a tilting angle formed by an intersecting ridgeline between the communication groove and the outer peripheral surface of the reaming portion with the axis when the axis is viewed from the radially outer side to be in the range of 25° to 70°. When the bit body is pulled out without being rotated, if the tilting angle is smaller than the above-described range, the communication groove becomes almost parallel to the axis. On the other hand, if the tilting angle is larger than the above-described range, the communication groove is almost perpendicular to the axis. Consequently, in any case, there is a problem in that it is difficult to efficiently guide the debris into the debris groove when the bit body is pulled out.

However, for example, if the digging bit is a reaming bit used in enlarging a borehole formed in advance by normal digging, if the outer diameter of the reaming portion is larger than the outer diameter of the rear end portion of the bit body as compared to a general digging bit, and if a lot of debris remains in a portion between the borehole and the rear end portion of the bit body, the above-described tilting angle may be less than 25° in view of the bit body which is pulled out while being rotated in the rotating direction during digging. As described above, the intersecting ridgeline located on the rear side in the rotating direction of the bit body at least during digging, within the intersecting ridgelines between the communication groove and the rear end surface of the reaming portion may be located on a plane parallel to the axis or on a plane including the axis.

Advantageous Effects of Invention

As described above, according to an aspect of the present invention, it is possible to reduce digging resistance while maintaining performance of discharging debris when a borehole is formed. It is possible to efficiently discharge debris remaining in an outer periphery of a rear end portion of a bit body to the front end side of the bit body when the bit body is pulled out from the borehole after digging is completed. Therefore, it is possible to reliably recover the bit body.

DESCRIPTION OF EMBODIMENTS

Figure 1:
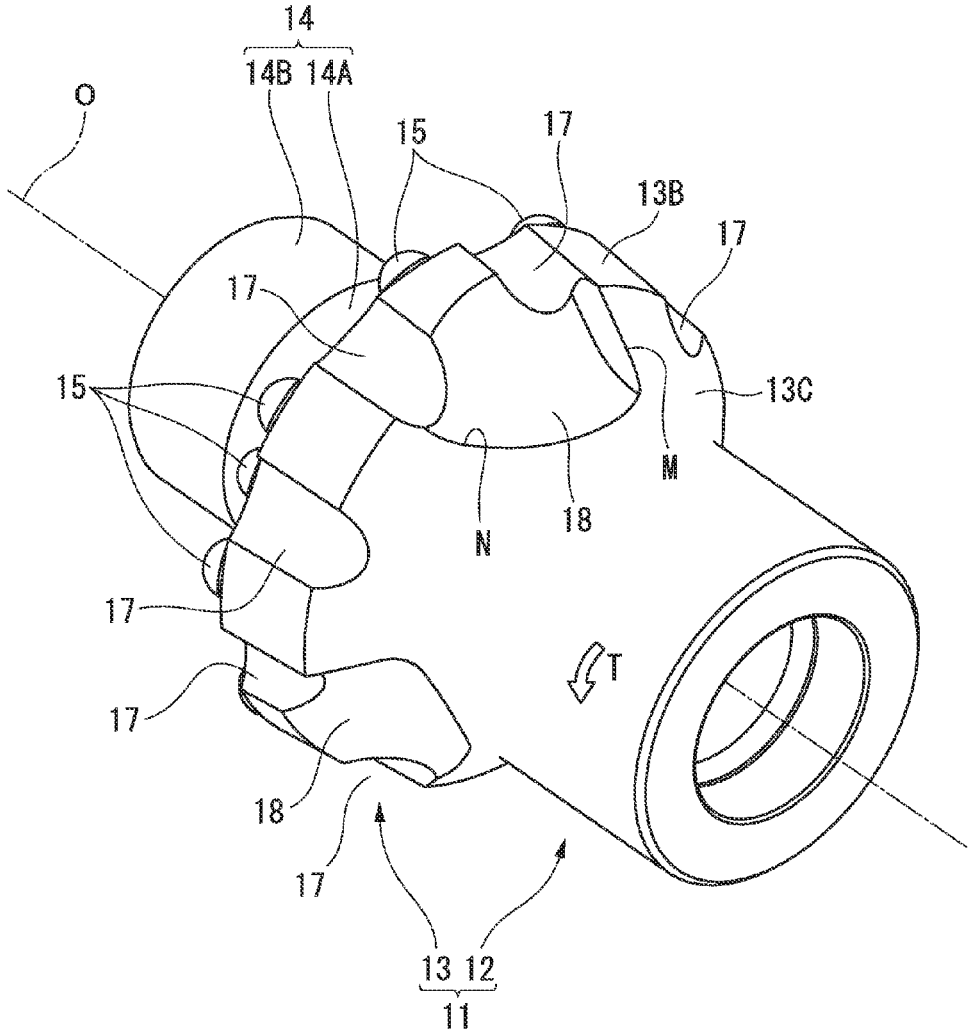
FIG. 1 is a perspective view illustrating a first embodiment according to the present invention when viewed from an outer peripheral side in a rear end.
Figure 2:
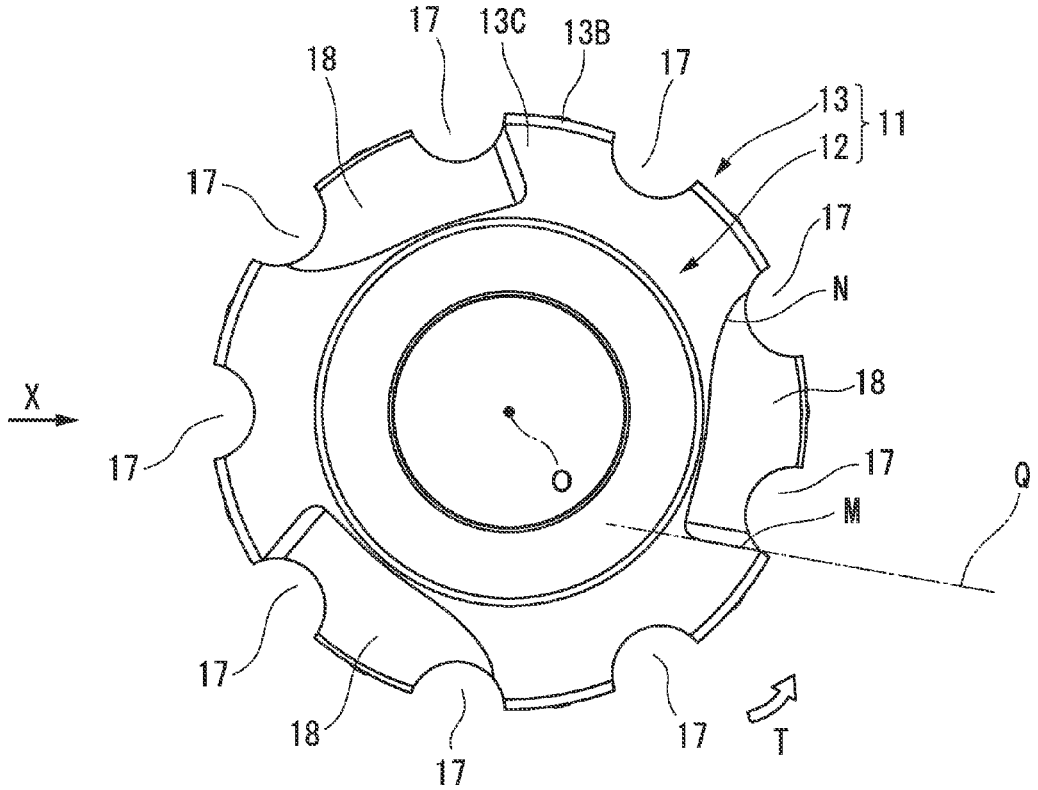
FIG. 2 is a rear view when the embodiment illustrated in FIG. 1 is viewed from the rear end side.
Figure 3:
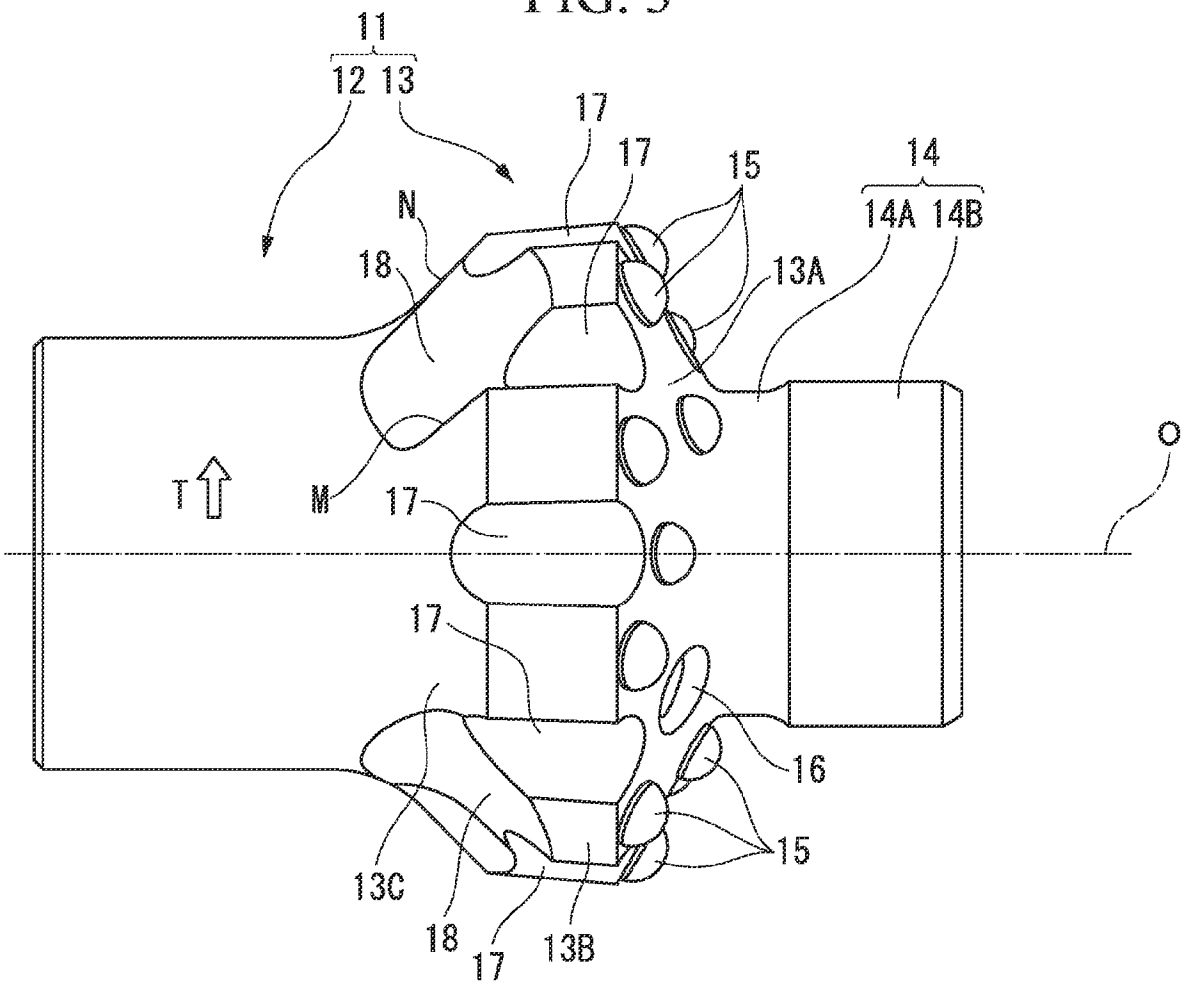
FIG. 3 is a side view in a direction of an arrow X in FIG. 2.
Figure 4:
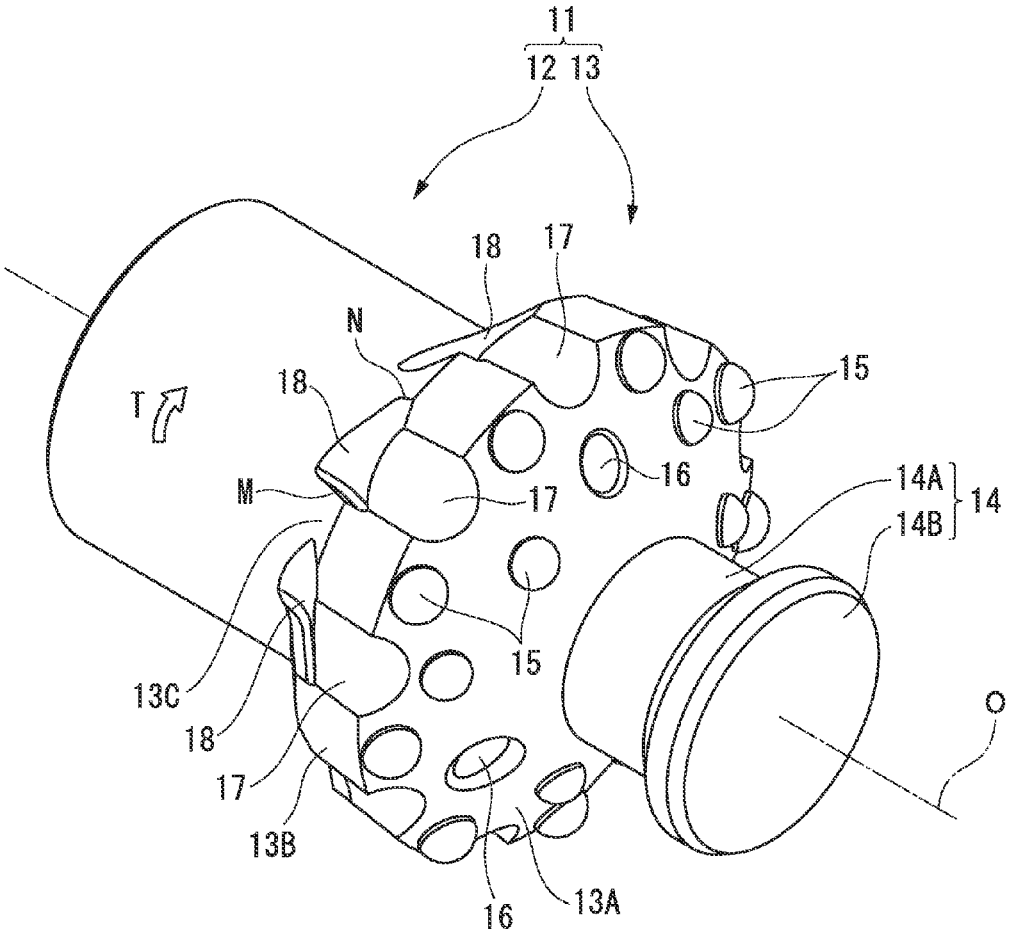
FIG. 4 is a perspective view illustrating a second embodiment according to the present invention when viewed from an outer peripheral side in a front end.
Figure 5:
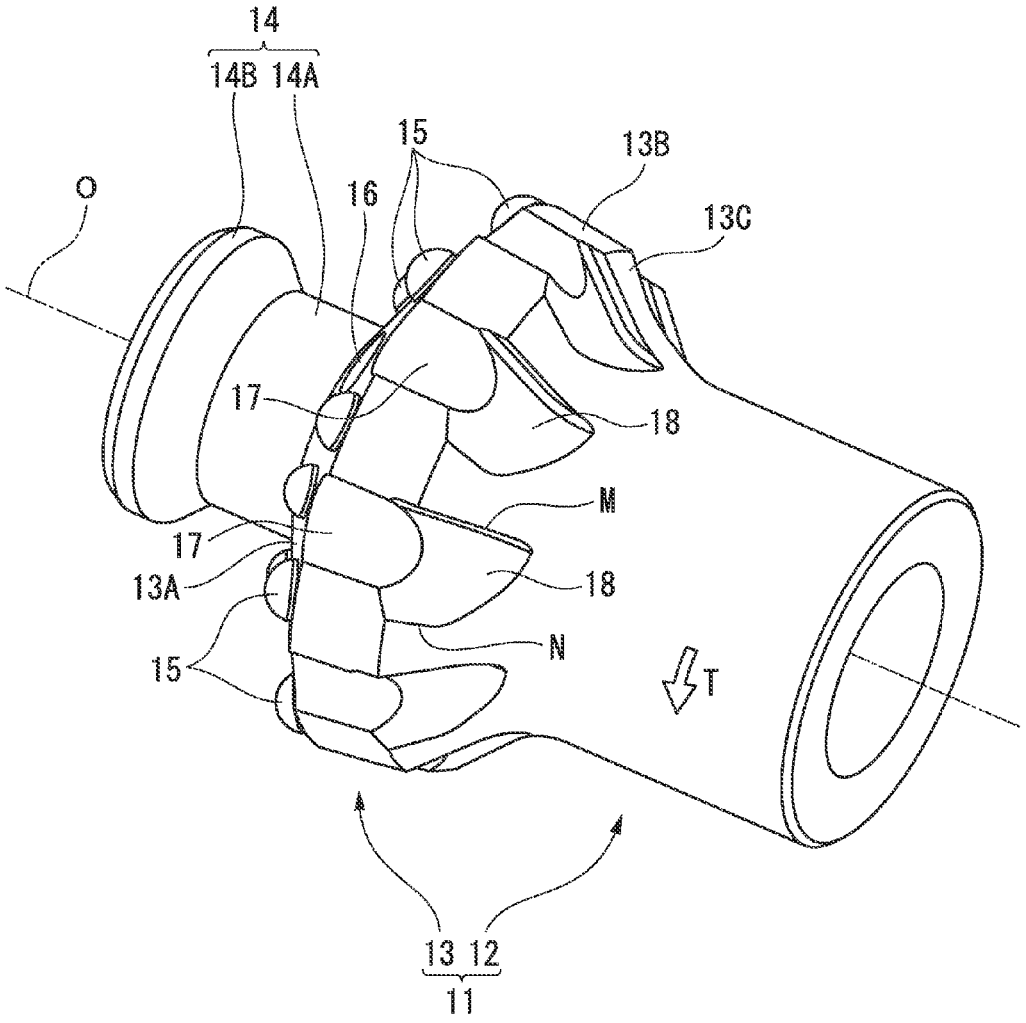
FIG. 5 is a perspective view when the embodiment illustrated in FIG. 4 is viewed from the outer peripheral side in the rear end.

FIGS. 1 to 3 illustrate a first embodiment of the present invention. A digging bit according to the present embodiment is called a reaming bit which is inserted into a small diameter borehole formed in advance so as to enlarge the borehole. In the present embodiment, a bit body 11 is integrally formed by using a metal material such as steel, and has a substantially bottomed-cylinder shape which is formed in multiple stages around an axis O.

A rear end portion (lower right portion in FIG. 1, left portion in FIG. 3) of the bit body 11 functions as a cylindrical skirt portion 12 which has a constant outer diameter. A reaming portion 13 whose outer diameter is larger than the skirt portion 12 is formed on a front end side (upper left portion in FIG. 1, right portion in FIG. 3) of the skirt portion 12. Furthermore, a pilot portion 14 whose outer diameter is smaller than the skirt portion 12 is formed on a front end side of the reaming portion 13 so as to protrude along the axis O of the bit body 11.

In the present embodiment, a front end surface 13A of the reaming portion 13 has a truncated cone surface shape formed around the axis O which tilts toward a rear end side as the entire body goes toward the outer peripheral side. The pilot portion 14 is formed integrally with the reaming portion 13 in the center of the front end surface 13A, and is formed in a cylindrical shape with multiple stages, which includes a small diameter portion 14A connected to the front end surface 13A, having a constant diameter, and formed around the axis O, and a large diameter portion 14B formed on a front end side of the small diameter portion 14A and having a slightly larger diameter than the small diameter portion 14A. The outer diameter of the large diameter portion 14B is smaller than the outer diameter of the skirt portion 12, and has a size which enables the large diameter portion 14B to be inserted into a small diameter borehole formed in advance.

Multiple digging tips 15 made of cemented carbide alloy, which are harder than the bit body 11, are arranged unit by unit on the front end surface 13A of the reaming portion 13. The digging tip 15 according to the present embodiment is a button tip in which a rear end portion having a columnar shape and a front end portion having a convex and spherical surface shape whose center is located on a central line of the rear end portion are formed integrally with each other. The rear end portion of the digging tip 15 is inserted to a circular hole formed on the front end surface 13A by means of shrink-fitting, press-fitting, or brazing. In this manner, the digging tips 15 are planted in such a way that each of the front end portions protrude from the front end surface 13A so that the above-described central line is perpendicular to the front end surface 13A.

In contrast, a female screw portion is formed on an inner peripheral surface of the skirt portion 12, and a male screw portion in a front end of a digging rod (not illustrated) is screwed into the female screw portion. The bit body 11 causes the digging tips 15 to crush rocks and to dig a borehole in the rocks by using thrust force and striking force transferred from a rock drilling machine via the digging rod and acting toward the front end side in the direction of axis O, and by using rotational force acting around the axis O in a rotating direction T during digging. In this manner, the bit body 11 enlarges a small diameter borehole formed in advance. A direction in which the male screw portion is screwed into the female screw portion is the same as the rotating direction T of the bit body 11 during digging. The bit body 11 is set so that the rotational force during digging does not loosen the screwing between the female screw portion and the male screw portion.

Furthermore, a blow hole 16 extending from a bottom surface of the inner peripheral portion of the skirt portion 12 toward the front end side is formed inside the reaming portion 13. The blow hole 16 is open on the front end surface 13A of the reaming portion 13, for example, at multiple locations which are separated from each other in the radial direction with respect to the axis O. The multiple digging tip 15 planted on the front end surface 13A are configured so as to avoid the blow holes 16. The multiple digging tip 15 are planted so that a rotational trajectory around the mutual axis O continuously extends from a position slightly separated to the outer peripheral side from the axis O to the outer peripheral edge of the front end surface 13A.

An outer peripheral surface 13B of the reaming portion 13 has a truncated cone shape formed around the axis O, which tilts more gently than the front end surface 13A tilting from the axis O, and which tilts toward the inner peripheral side as it goes close to the rear end side. In addition, a rear end surface 13C of the reaming portion 13 has a truncated cone surface shape formed around the axis O, which tilts more steeply than the outer peripheral surface 13B, which tilts substantially equal to the front end surface 13A, for example, and which tilts toward the inner peripheral side as the entire body goes toward the rear end side. Then, the rear end of the rear end surface 13C has a concave and curved shape in cross section, and is connected to the outer peripheral surface of the skirt portion 12.

Furthermore, multiple rows (nine rows in the present embodiment) of debris groove 17 extending in the direction of axis O from the front end surface 13A to the rear end surface 13C of the reaming portion 13 are formed on the outer peripheral surface 13B of the reaming portion 13. The bottom surface of the debris groove 17 according to the present embodiment has a concave and curved surface shape such as a concave and cylindrical surface shape having the central line extending in the direction of axis O. The debris grooves 17 having the same shape and the same size are formed at equal intervals in the circumferential direction.

A communication groove 18 which communicates with the debris groove 17 is formed from the outer peripheral surface 13B to the rear end surface 13C of the reaming portion 13. Here, in the communication groove 18 according to the present embodiment, as in the communication groove 18 illustrated on the right side in FIG. 2, an intersecting ridgeline M located on the rear side in the rotating direction T of the bit body 11 during digging, within intersecting ridgelines M and N between the communication groove 18 and the rear end surface 13C of the reaming portion 13, is located on a plane Q parallel to the axis O. The intersecting ridgeline M may be located on a plane including the axis O as will be described in a second embodiment (to be described later).

In addition, the communication groove 18 according to the present embodiment is configured so that a width thereof in the circumferential direction is larger than a width of the debris groove 17 in the circumferential direction. In particular, the communication groove 18 according to the present embodiment also communicates with the multiple debris grooves 17 which are adjacent to each other in the circumferential direction, among the multiple debris groove 17 formed in the outer peripheral portion of the reaming portion 13 at intervals in the circumferential direction.

Specifically, in the present embodiment, nine rows of debris grooves 17 are formed in the outer peripheral portion of the reaming portion 13 at equal intervals in the circumferential direction as described above. In contrast, in a case of the communication groove 18, three rows of communication grooves 18 which respectively communicate with every two rows of debris grooves 17 which are adjacent to each other in the circumferential direction are formed at equal intervals in the circumferential direction. A total of three rows of debris grooves 17 which do not communicate with the communication grooves 18 are formed between the communication grooves 18.

Furthermore, the intersecting ridgeline M is substantially connected to the intersecting ridgeline on the rear side in the rotating direction T, within the intersecting ridgelines between the debris groove 17 on the rear side in the rotating direction out of the two rows of debris grooves 17 communicating with the communication groove 18 and the outer peripheral surface 13B of the reaming portion 13. A wall surface facing the rotating direction T of the communication groove 18 connected to the intersecting ridgeline M has a concave and curved surface shape extending in the rotating direction T toward the inner peripheral side of the bit body 11.

In addition, a bottom surface of the communication groove 18 facing the outer peripheral side of the bit body 11 is also formed in the concave and curved surface shape.

The width in the direction of the axis O of the outer peripheral surface 13B of the reaming portion 13 remaining between two rows of debris grooves 17 communicating with the communication groove 18 is smaller than the width of the outer peripheral surface 13B between the other debris grooves 17. In addition, an intersecting ridgeline N between the communication groove 18 in the rotating direction T side and the rear end surface 13C of the reaming portion 13 draws a convex curve as it goes in the rotating direction T side, and is cut so as to rise on the front end side of the bit body 11. Then, the intersecting ridgeline N intersects the intersecting ridgeline between the debris groove 17 in the rotating direction side T out of two rows of debris grooves 17 communicating with the communication groove 18 and the rear end surface 13C of the reaming portion 13.

As described above, thrust force and striking force which act toward the front end side in the direction of axis O, and rotational force which acts in the rotating direction T are applied to the digging bit (reaming bit) having the above-described configuration. In this manner, rocks around the small diameter borehole formed in advance are crushed into debris by the digging tip 15 arranged on the front end surface 13A of the reaming portion 13, thereby enlarging the borehole. During digging, the debris is pushed out to the outer periphery of the skirt portion 12 through the debris groove 17 by ejecting compressed air through the blow hole 16 of a digging rod, and is discharged to the rear end side of the bit body 11. Furthermore, during digging, the pilot portion 14 is inserted into the small diameter borehole, thereby guiding the bit body 11.

In this case, in the above-described digging bit, it is not necessary to form a large diameter portion for disposing a cutting blade in the rear end portion of the bit body as in the retractable bit in the related art. In particular, according to the present embodiment, the rear end portion of the bit body 11 functions as the skirt portion 12 having a constant outer diameter. Accordingly, the debris fed to the rear end side from the debris groove 17 can be discharged to the rear end side of the bit body 11 without the bit body 11 being filled with the debris due to the large diameter portion. Therefore, it is possible to efficiently form a borehole with less digging resistance along with preventing performance for discharging the debris from becoming poor.

Then, when the bit body 111 recovered after the borehole is enlarged to reach a predetermined depth, the bit body 11 is particularly rotated in the same direction as the rotating direction T during digging, and is pulled out to the rear end side in the direction of the axis O. In this manner, the debris remaining between the skirt portion 12 and the borehole can be discharged to the front end side of the reaming portion 13 from the communication groove 18 through the debris groove 17. Therefore, according to the above-described digging bit, the bit body 11 can be reliably recovered from the borehole.

In addition, the digging bit for enlarging the small diameter borehole as in the reaming bit according to the present embodiment is configured so that an outer diameter difference and an outer diameter ratio between the skirt portion 12 and the reaming portion 13 whose diameter is larger than the skirt portion 12 increases. Therefore, it is possible to ensure longer intersecting ridgelines M and N between the communication groove 18 and the rear end surface 13C of the reaming portion 13. Even if at least any one of the intersecting ridgelines M and N is located on the plane Q parallel to the axis O or on the plane including the axis O, the debris can be reliably fed to the debris groove 17 by being taken along the communication groove 18.

Furthermore, according to the present embodiment, the width of the communication groove 18 in the circumferential direction is larger than the width of the respective debris grooves 17 in the circumferential direction. Accordingly, a lot of debris is received by the communication groove 18 and fed into the debris groove 17, thus the debris can be efficiently discharged to the front end side of the bit body. Furthermore, according to the present embodiment, one row of communication grooves 18 communicates with every two rows of debris grooves 17 which are adjacent to each other in the circumferential direction, within the multiple debris grooves 17. Accordingly, a lot of debris taken along the communication groove 18 in this way can be more efficiently discharged by being dispersed to the debris grooves 17. As described above, even if the communication groove 18 does not communicate with some of the debris grooves 17, the bit body 11 can be reliably recovered. However, the communication groove 18 may be formed so as to communicate with all of the debris grooves 17.

Furthermore, the communication groove 18 according to the present embodiment is formed so that the depth from the rear end surface 13C of the reaming portion 13 becomes gradually deeper toward the rear side in the rotating direction T of the bit body 11 during digging. Accordingly, the bit body 11 is particularly pulled out while being rotated in the rotating direction T during digging. In this manner, a lot of debris can be accommodated in the rear side portion in the rotating direction T of the communication groove 18 which becomes deeper. Therefore, debris discharging can be more efficiently promoted.

In the pilot portion 14 according to the present embodiment, the width of the large diameter portion 14B in the direction of the axis O is smaller than that of the small diameter portion 14A. Therefore, an advantageous effect can be obtained in that the bit body 11 can be stably guided when the small diameter borehole is enlarged.

Next, FIGS. 4 to 8 illustrate a second embodiment of the present invention. A digging bit according to the second embodiment is also a reaming bit for enlarging a small diameter borehole formed in advance, similarly to the first embodiment. The same reference numerals are given to elements which are common to those in the first embodiment.

According to the present embodiment, every row of communication grooves 18 is formed so as to communicate with each of the multiple rows (nine rows) of debris grooves 17 formed in the outer periphery of the reaming portion 13.

The communication grooves 18 are also formed at equal intervals in the circumferential direction. In addition, as in the communication groove 18 illustrated on the left side in FIG. 6, in the communication groove 18 according to the present embodiment, the intersecting ridgeline M located on the rear side in the rotating direction T of the bit body 11 during digging, within the intersecting ridgelines M and N between the communication groove 18 and the rear end surface 13C of the reaming portion 13, is located on the plane P including the axis O.

Figure 6:
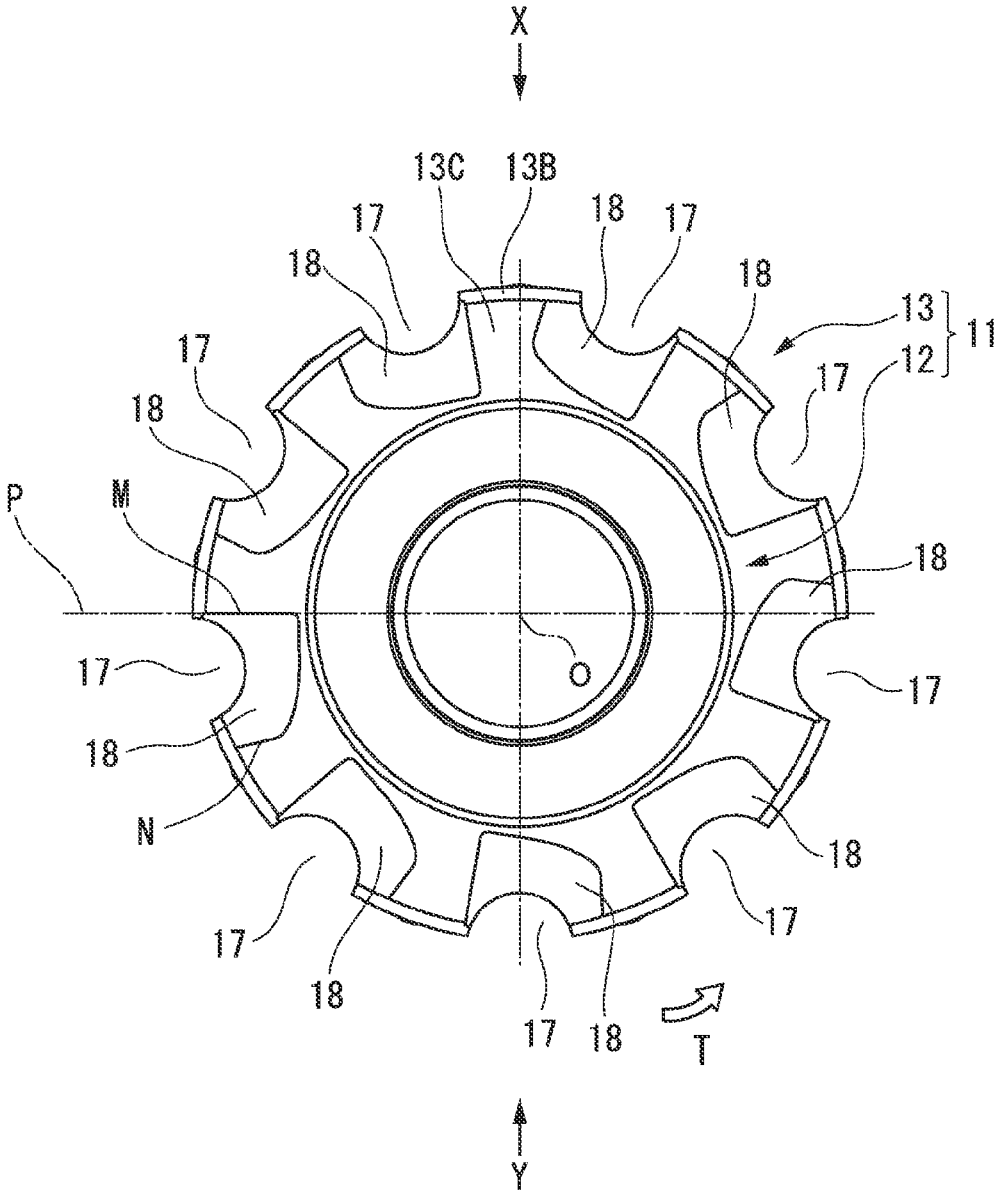
FIG. 6 is a rear view when the embodiment illustrated in FIG. 4 is viewed from the rear end side.
Figure 7:
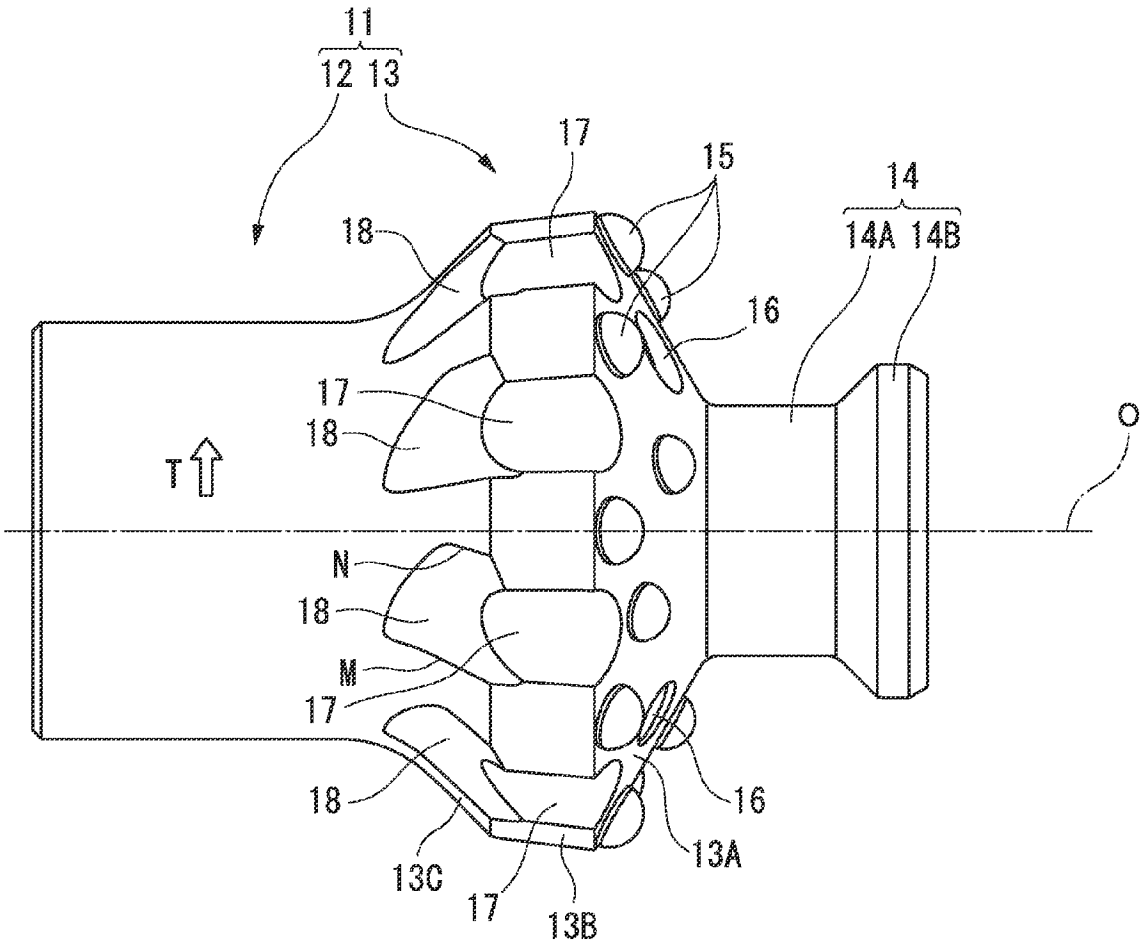
FIG. 7 is a side view (plan view) in the direction of the arrow X in FIG. 6.
Figure 8:
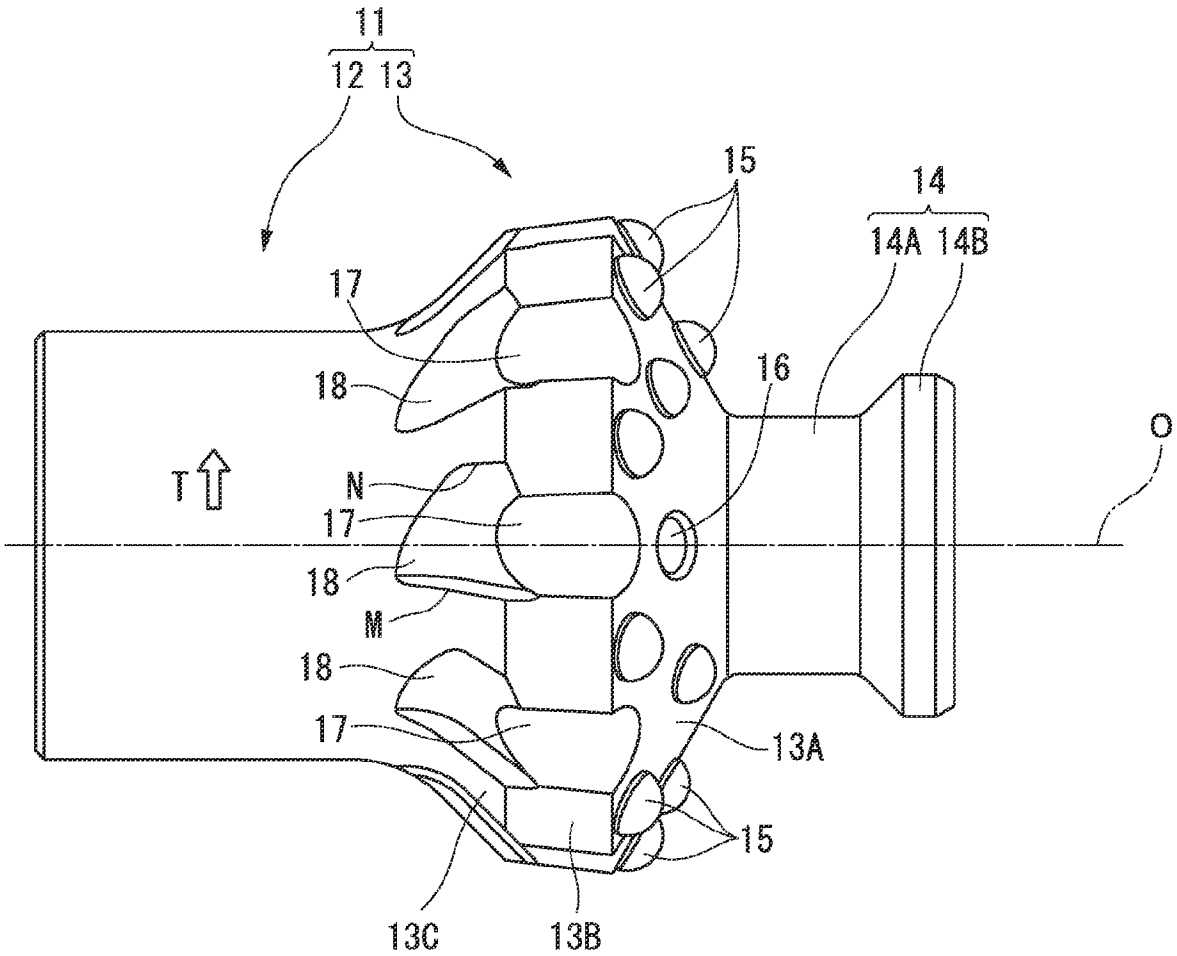
FIG. 8 is a side view (bottom view) in a direction of an arrow Y in FIG. 6.
Figure 9:
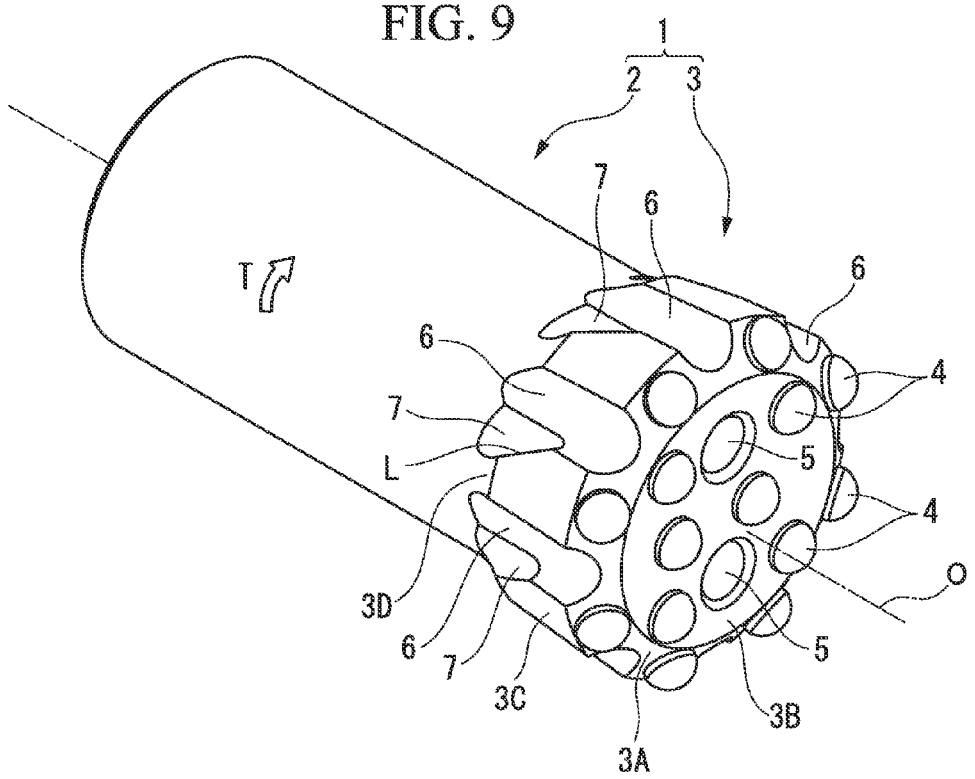
FIG. 9 is a perspective view illustrating a third embodiment of the present invention.
Figure 10:
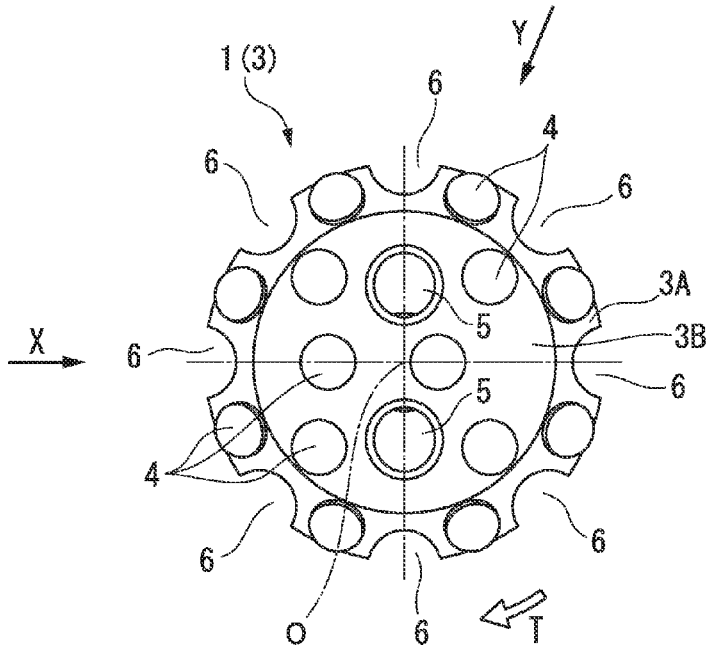
FIG. 10 is a front view of the embodiment illustrated in FIG. 9.
Figure 11:
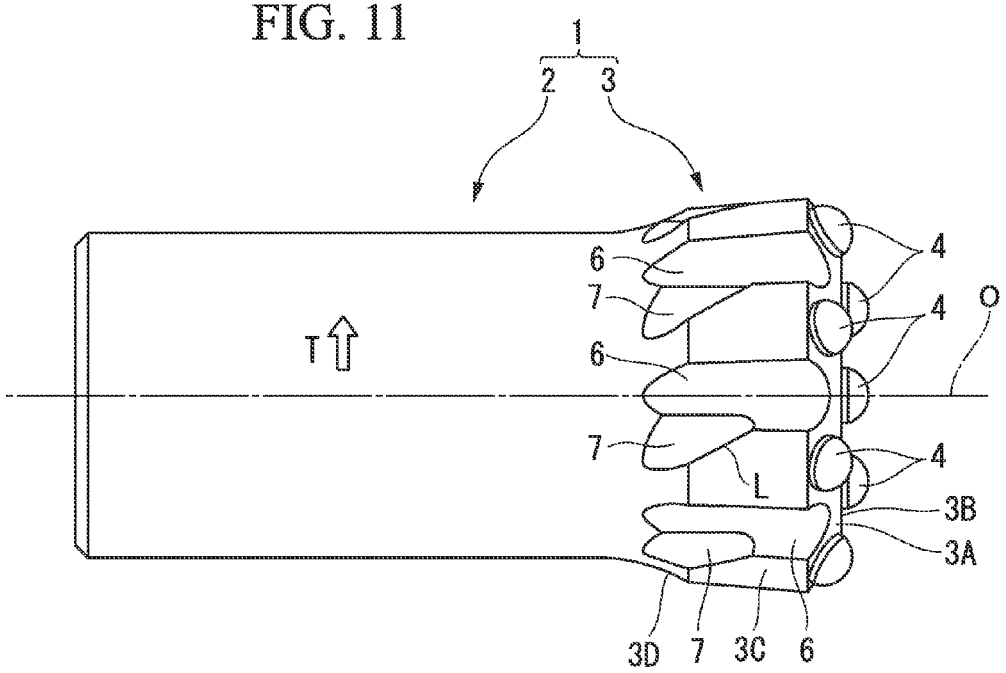
FIG. 11 is a side view in the direction of the arrow X in FIG. 10.
Figure 12:
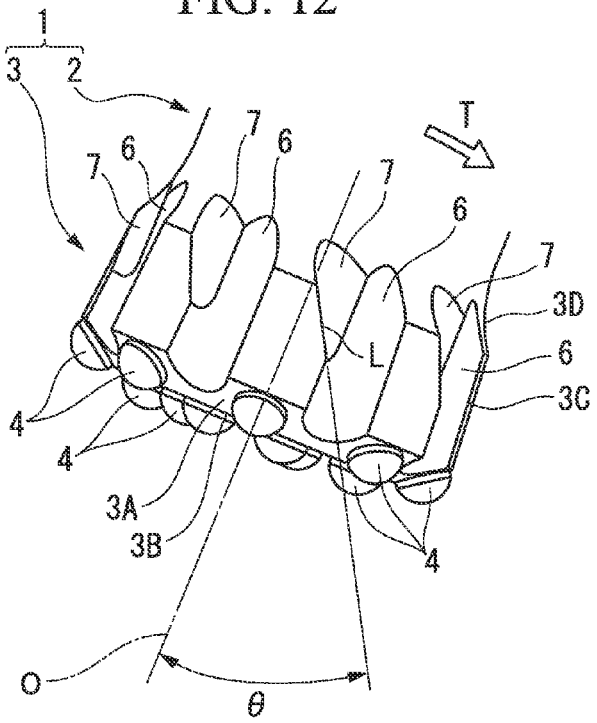
FIG. 12 is a side view when a front end portion of a bit body according to the embodiment illustrated in FIG. 9 is viewed in the direction of the arrow Y in FIG. 10.

Furthermore, the communication groove 18 according to the present embodiment is also configured so that the width in the circumferential direction is larger than the width of the debris groove 17 in the circumferential direction. Specifically, as illustrated in FIG. 6, the communication groove 18 according to the present embodiment is formed so that the above-described intersecting ridgelines M and N are respectively located on the further outer side in the circumferential direction than the intersecting ridgeline between the debris groove 17 and the outer peripheral surface 13B of the reaming portion 13. As illustrated in FIG. 6, the intersecting ridgeline N in the rotating direction T side may be located on the plane parallel to the axis O, or may draw a convex curve as it goes in the rotating direction T side, and may be cut so as to rise on the front end side of the bit body 11 as in the first embodiment.

However, on the rear side in the rotating direction T within the circumferential direction, the intersecting ridgeline M is located on the slightly rear side in the rotating direction T of the intersecting ridgeline between the debris groove 17 and the outer peripheral surface 13B of the reaming portion 13. In contrast, in the rotating direction T, the intersecting ridgeline N between the communication groove 18 in the rotating direction T side and the rear end surface 13C of the reaming portion 13 is formed so at to be located in the rotating direction T side with an interval which is larger than the interval between the intersecting ridgeline M and the debris groove 17.

Furthermore, according to the present embodiment, the communication groove 18 is also formed so that the groove depth from the rear end surface 13C of the reaming portion 13 gradually becomes deeper toward the rear side in the rotating direction T during digging. The communication groove 18 is cut so as to rise on the outer peripheral side on the rear side in the rotating direction T, and reaches the intersecting ridgeline M. The intersecting ridgeline between the communication groove 18 connecting the rear ends of the intersecting ridgelines M and N in the direction of the axis O and the end surface 13C of the reaming portion 13 extends toward the rear end side in the direction of the axis O as it goes toward the rear side in the rotating direction T.

In the digging bit (reaming bit) according to the above-described second embodiment, after a borehole is enlarged to reach a predetermined depth, the bit body 11 is also particularly pulled out to the rear end side in the direction of the axis O while being rotated in the same direction as the rotating direction T during digging, similarly to the first embodiment. In this manner, debris remaining between the skirt portion 12 and the borehole can be discharged from the communication groove 18 to the front end side of the reaming portion 13 through the debris groove 17. In addition, according to the present embodiment, every one row of communication grooves 18 communicates with all of the debris grooves 17. Therefore, there is less possibility that the debris grooves 17 are filled with the debris.

In addition, according to the present embodiment, the width of the communication groove 18 in the circumferential direction is also larger than the width of the debris groove 17 in the circumferential direction. Accordingly, a lot of debris is received by the communication groove 18 and fed into the debris groove 17, thus the debris can be efficiently discharged to the front end side of the bit body. In particular, according to the present embodiment, the intersecting ridgelines M and N between the communication groove 18 and the rear end surface 13C of the reaming portion 13 and between the rotating direction T and both of these on the rear side are located on both outer sides of the debris groove 17 in the circumferential direction. Therefore, the debris taken along the communication groove 18 can be evenly fed into the debris groove 17.

Furthermore, according to the present embodiment, the groove depth of the communication groove 18 from the rear end surface 13C of the reaming portion 13 also gradually becomes deeper toward the rear side in the rotating direction T of the bit body 11 during digging. Accordingly, the bit body 11 is pulled out while being rotated in the rotating direction T during digging. In this manner, a lot of debris can be accommodated in the rear side portion which becomes deeper in the rotating direction T. Therefore, debris discharging can be more efficiently promoted. in this case, in the communication groove 18 which is further enlarged than the debris groove 17 as described above, the circumferential interval between the intersecting ridgeline M on the rear side in the rotating direction T and the debris groove 17 is smaller than the interval between the intersecting ridgeline N in the rotating direction T side and the debris groove 17. Therefore, the debris accommodated on the rear side in the rotating direction T in this way can be discharged without causing the debris to remain inside the communication groove 18.

Figure 13:
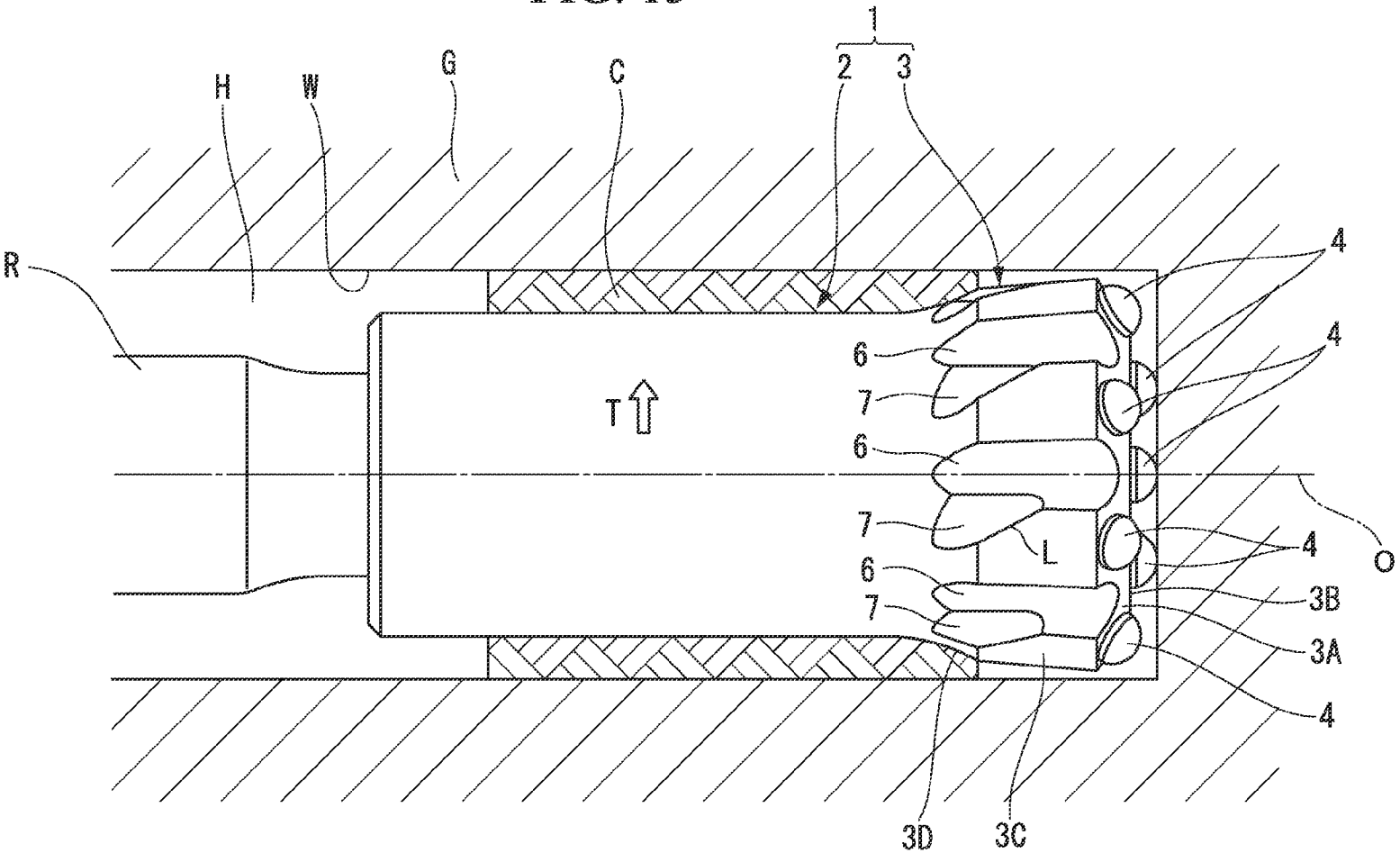
FIG. 13 is a side view when a borehole is formed according to the embodiment illustrated in FIG. 9.

FIGS. 9 to 13 illustrate a third embodiment of the present invention, and FIG. 13 illustrates a case where a borehole H is formed in rocks G in accordance with the third embodiment. A digging bit according to the present embodiment is not a reaming bit for enlarging a small borehole formed in advance, unlike those according to the first and second embodiments. The digging bit is exclusively used in forming a borehole in rocks in which a borehole is not formed in advance.

In the present embodiment, a bit body 1 is also integrally formed by using a metal material such as steel, and also has a substantially bottomed-cylinder shape which is formed in multiple stages around the axis O. A rear end portion (upper left portion in FIG. 9, left portion in FIGS. 11 and 13) of the bit body 1 functions as a cylindrical skirt portion 2 which has a constant outer diameter. A front end portion (lower right portion in FIG. 9, right portion in FIGS. 11 and 13) of the bit body 1, which is a bottom portion of the bottomed shape, functions as a reaming portion 3 whose outer diameter is larger than the skirt portion 2. However, an outer diameter difference and an outer diameter ratio between the skirt portion 2 and the reaming portion 3 is smaller than those in the first and second embodiments. In addition, a pilot portion is not formed in a front end of the bit body 1.

A gauge surface 3A having a truncated cone surface shape around the axis O tilting toward the rear end side as it goes toward the outer peripheral side is formed in the outer periphery of the front end portion of the reaming portion 3. A contacting surface 3B which as a circular shape around the axis O and faces the front end side perpendicularly to the axis O is formed on the inner peripheral side of the gauge surface 3A. An outer peripheral surface 3C of the reaming portion 3 connected to the rear end side of the gauge surface 3A has a truncated cone surface shape around the axis O tilting toward the inner peripheral side as it goes toward the rear end side. However, tilting from the axis O is gentler than tilting of the gauge surface 3A. Furthermore, a rear end surface 3D of the reaming portion 3 on the further rear end side from the outer peripheral surface 3C having this truncated cone surface shape has a concave and curved shape in cross section along the axis O, for example, and is formed so as to come into contact with the outer peripheral surface of the skirt portion 2.

According to the present embodiment, button tips serving as digging tips 4 are planted on the gauge surface 3A and the contacting surface 3B of the reaming portion 3 so that a central line thereof is perpendicular to the gauge surface 3A and the contacting surface 3B. Multiple digging tips 4 are respectively arranged unit by unit so that the front end portion protrudes from the gauge surface 3A and the contacting surface 3B. In addition, a blow hole 5 is open at two locations having equal intervals from the axis O in the radial direction with respect to the axis O on the contacting surface 3B. The multiple digging tips (contacting tips) 4 planted on the contacting surface 3B are configured so as to avoid the blow holes 5. The multiple digging tips 4 are planted so that a rotational trajectory around the mutual axis O continuously extends from a position slightly separated to the outer peripheral side from the axis O to the outer peripheral edge of the contacting surface 3B.

Furthermore, multiple rows (eight rows in the present embodiment) of debris grooves 6 whose bottom surface has a concave and curved shape similarly to the first and second embodiments are formed in the outer peripheral portion of the reaming portion 3 at equal intervals in the circumferential direction. A diameter of a circle inscribed in the bottom surface of the debris groove 6 around the axis O of the bit body 1 is larger than a diameter of the contacting surface 3B having a circular shape, and substantially equal to the outer diameter of the skirt portion 2. The digging tips (gauge tips) 4 planted on the gauge surface 3A are arranged at equal intervals between opening portions where debris grooves 6 are open to the gauge surface 3A. The digging tips 4 planted in the outer peripheral edge of the contacting surface 3B are arranged on the inner peripheral side of the every other debris groove 6 in the circumferential direction.

Furthermore, a communication groove 7 which is open on the rear end surface 3D of the reaming portion 3 and communicates with the debris groove 6 is formed from the outer peripheral portion to the rear end portion of the reaming portion 3. Then, the communication groove 7 according to the present embodiment extends in a direction tilting to the axis O. According to the present embodiment, similarly to the second embodiment, every one of the communication grooves 7 having the same shape and the same size is also formed for each debris groove 6 so as to respectively communicate with the multiple debris groove 6. The respective communication grooves 7 are formed at an interval so as not to communicate with the debris groove 6 other than the communicated debris groove 6 or the other communication grooves 7.

In addition, the respective communication grooves 7 extend while tilting to the axis O when the axis O is viewed from the radially outer peripheral side so as to be oriented in the rotating direction T as the communication groove 7 is formed from positions of the rear end side in the rotating direction T if the communicating debris groove 6 and the rear end side in the direction of the axis O toward the front end side in the direction of the axis O. However, the communication groove 7 does not reach the gauge surface 3A, and is cut so as to rise in the substantially center of the outer peripheral surface 3C in the direction of the axis O. It is desirable to set a tilting angle θ formed by an intersecting ridgeline L between the communication groove 7 and the outer peripheral surface 3C of the reaming portion 3 with respect to the axis O when the axis O is viewed from the radially outer peripheral side to be in a range of 25° to 70°. According to the present embodiment, the tilting angle θ is set to 30°.

The groove depth from the outer peripheral surface 3C of the communication groove 7 is shallower than the groove depth from the outer peripheral surface 3C of the debris groove 6. In addition, a portion where the communication groove 7 is cut so as to rise on the outer peripheral surface 3C has a concave and curved shape such as a concave arc shape when the portion is viewed in a direction extending along the intersecting ridgeline L. A wall surface oriented in the rotating direction T which extends in the rotating direction T as it goes toward the front end side in the direction of the axis O is formed along the intersecting ridgeline L. Furthermore, a bottom surface of the communication groove 7 which faces the outer peripheral side of the bit body 1 has a convex and curved shape such as a convex and cylindrical surface having the central line parallel to the axis O, or a planar shape in contact with the convex and cylindrical surface.

As illustrated in FIG. 13, when the borehole H is formed in the rocks G by the digging bit according to the third embodiment as described above, if thrust force and striking force which act toward the front end side in the direction of axis O, and rotational force which acts in the rotating direction T are applied to the digging bit 1 via a digging rod R, the rocks G are crushed into debris by the digging tips 4 which are planted on the gauge surface 3A and contacting surface 3B in the front end of the bit body 1. During digging, the debris is pushed out to the outer periphery of the skirt portion 2 through the debris groove 6 by ejecting compressed air from the contacting surface 3B through the blow hole 5 of the digging rod R, and is discharged to the rear end side of the bit body 1.

Then, when the bit body 1 of each digging rod R is pulled out and recovered from the borehole H after the borehole H is formed to reach a predetermined depth, even if the rocks G are very likely to collapse and debris C generated due to the collapse remains between the skirt portion 2 in the rear end portion of the bit body 1 and a hole wall W of the borehole H, according to the digging bit having the above-described configuration, the communication groove 7 which is open on the rear end surface 3D and communicates with the debris groove 6 is formed from the outer peripheral portion to the rear end portion of the reaming portion 3. Accordingly, the debris C is fed into the debris groove 6 from the communication groove 7 as the bit body 1 is moved rearward.

In particular, according to the third embodiment, the communication groove 7 extends in the direction tilting to the axis O and communicates with the debris groove 6. Therefore, the debris C is fed into the debris groove 6 so as to be guided along the wall surface connected the intersecting ridgeline L of the communication groove 7 by only straightly pulling out the bit body 1 along the axis O, and is discharged to the front end side of the bit body 1. Therefore, according to the present embodiment, the debris C can also be efficiently discharged to the front end side of the bit body.

Furthermore, according to the present embodiment, the communication groove 7 communicates with the debris groove 6 while tilting toward the front end side of the bit body 1 in the direction of the axis O so as to be oriented in the rotating direction T of the bit body 1 during digging.

Accordingly, when the bit body 1 is pulled out from the borehole H, if the bit body 1 is moved rearward while being rotated in the same rotating direction T during digging so as not to loosen the screwing between the female screw portion and the male screw portion, the debris C fed into the communication groove 7 is pushed out to the front end side due to the rotation of the bit body 1, and is discharged to the front end side of the bit body 1 via the debris groove 6. Therefore, the bit body 1 can be reliably recovered by promoting the more efficient discharge of the debris C.

Furthermore, according to the present embodiment, the communication groove 7 is cut so as to rise in the substantially center of the reaming portion 3 in the direction of the axis O, and intersects the outer peripheral surface 3C in the intersecting ridgeline L. The intersecting ridgeline L also tilts in the rotating direction T of the bit body 1 during digging as it goes toward the front end side in the direction of the axis O. Accordingly, when the bit body 1 is pulled out, the intersecting ridgeline L functions as a cutting blade. In this manner, the debris generated due to the collapse in the outer periphery of the reaming portion 3 can also be taken into the communication groove 7, and can be discharged to the front end side through the debris groove 6. Therefore, it is possible to more smoothly recover the bit body 1 by securing a clearance between the reaming portion 3 and the hole wall W of the borehole H.

On the other hand, since the communication groove 7 is cut o as to rise in the substantially center of the reaming portion 3 in the direction of the axis O, the front end portion of the reaming portion 3 can sufficiently secure the thickness between the debris grooves 6 which are adjacent to each other in the circumferential direction. Accordingly, there is no possibility of weakening strength for retaining the digging tips 4 planted to the gauge surface 3A in the front end surface of the reaming portion 3. In addition, it is also possible to secure a sufficient circumferential length for the intersecting ridgeline between the gauge surface 3A of the reaming portion 3 which has the largest outer diameter in the bit body 1 and the outer peripheral surface 3C. Therefore, it is possible to prevent the borehole H from being bent when the borehole H is formed.

Furthermore, according to the present embodiment, the tilting angle θ formed by the intersecting ridgeline L between the communication groove 7 and the outer peripheral surface 3C of the reaming portion 3 with the axis O when the axis O is viewed from the radially outer peripheral side is in a range of 25° to 70°. This configuration also enables the debris C to be efficiently discharged when the bit body 1 is pulled out. That is, if the tilting angle θ is smaller than the above-described range, the wall surface of the communication groove 7 becomes almost parallel to the axis O. On the other hand, if the tilting angle θ is greater than the above-described range, the wall surface of the communication groove 7 becomes almost perpendicular to the axis O. Consequently, in any case, there is a problem in that it is difficult to efficiently feed the debris C into the debris groove 6 along the communication groove 7 when the bit body 1 is moved rearward along the axis O, for example.

According to the above-described first to third embodiments, the skirt portions 2 and 12 in the rear end portion of the bit bodies 1 and 11 have a cylindrical shape which is formed around the axis O and has a constant outer diameter. However, as long as the discharge of debris is not hindered or a portion is not filled with the debris, a large diameter portion whose diameter is sufficiently smaller than that of the reaming portions 3 and 13 in the front end portion of the bit bodies 1 and 11 may be formed in the outer periphery of the skirt portions 2 and 12.

Hitherto, preferred embodiments of the present invention have been described, but the present invention is not limited to the above-described embodiments. Within the scope not departing from the concept of the present invention, the configurations can be added, omitted, replaced, and modified in various ways. Without being limited by the above-description, the present invention is limited by only appended claims.

INDUSTRIAL APPLICABILITY

The present invention relates to a digging bit in which a digging tip is arranged in a front end portion of a bit body rotated around an axis so as to form a borehole in rocks. According to the digging bit of the present invention, a reaming portion whose diameter is larger than that of a rear end portion of the bit body is formed in the front end portion of the bit body rotated around the axis. The digging tip is arranged in the front end portion of the reaming portion, and a debris groove extending in the direction of the axis is formed in an outer peripheral portion of the reaming portion. A communication groove communicating with the debris groove is formed from the outer peripheral portion of the reaming portion to the rear end portion of the reaming portion. In this manner, digging resistance can be reduced while performance for discharging the debris can be maintained when the borehole is formed. When the bit body is pulled out from the borehole after the digging is completed, debris remaining in the outer periphery of the rear end portion of the bit body can be efficiently discharged through the debris groove to the front end side of the bit body, and the bit body can be reliably recovered. Therefore, the present invention is industrially applicable.

DESCRIPTION OF THE REFERENCE SYMBOLS

1, 11 BIT BODY
2, 12 SKIRT PORTION
3, 13 REAMING PORTION
3A GAUGE SURFACE
3B CONTACTING SURFACE
3C, 13B REAMING PORTION
3, 13 OUTER PERIPHERAL SURFACE
3D, 13C REAMING PORTION
3, 13 REAR END SURFACE
4, 15 DIGGING TIP
5, 16 BLOW HOLE
6, 17 DEBRIS GROOVE
7, 18 COMMUNICATION GROOVE
13A FRONT END SURFACE OF REAMING PORTION 13
14 PILOT PORTION
O AXIS OF BIT BODY 1, 11
P PLANE INCLUDING AXIS O
T ROTATING DIRECTION OF BIT BODY 1, 11 DURING DIGGING
L INTERSECTING RIDGELINE BETWEEN COMMUNICATION GROOVE 7 AND OUTER PERIPHERAL SURFACE 3C OF REAMING PORTION 3
M INTERSECTING RIDGELINE BETWEEN COMMUNICATION GROOVE 18 ON REAR SIDE IN ROTATING DIRECTION T AND REAR END SURFACE 13C OF REAMING PORTION 13

N INTERSECTING RIDGELINE BETWEEN COMMUNICATION GROOVE 18 IN ROTATING DIRECTION T SIDE AND REAR END SURFACE 13C OF REAMING PORTION 13

θ TILTING ANGLE FORMED BY INTERSECTING RIDGELINE L WITH AXIS O WHEN AXIS O IS VIEWED FROM RADIALLY OUTER PERIPHERAL SIDE

The invention claimed is:

1. A digging bit for forming a borehole in rocks, comprising:

a bit body having a reaming portion formed in a front end portion of the bit body, a diameter of the reaming portion is larger than that of a rear end portion of the bit body, the bit body being rotated around a rotational axis of the digging bit;

a digging tip which is arranged in a front end surface of the reaming portion;

a debris groove which is formed in a concave curved shape on an outer peripheral surface of the reaming portion, and which extends from the front surface of the reaming portion to a rear end surface thereof; and a communication groove communicating with the debris groove, and is formed in a concaved curved shape from the outer peripheral surface of the reaming portion to the rear end surface thereof.

2. The digging bit according to claim 1, wherein the reaming portion includes intersecting ridgelines located between the rear end surface and the communication groove, one of the intersecting ridgelines is located on one of a plane parallel to the rotational axis and a plane including the rotational axis.

3. The digging bit according to claim 2, wherein a width of the communication groove is larger than a width of the debris groove in a circumferential direction of the digging bit.

4. The digging bit according to claim 3, further comprising:

a plurality of the debris grooves formed on the outer peripheral surface of the reaming portion at intervals in the circumferential direction, and a plurality of the communication grooves respectively communicates with the plurality of the debris grooves which are adjacent to each other in the circumferential direction.

5. The digging bit according to claim 4, wherein the communication groove is configured so that a groove depth thereof gradually becomes deeper from the rear end surface of the reaming portion toward the rear side in a rotating direction of the digging bit.

6. The digging bit according to claim 3, wherein the communication groove is configured so that a groove depth thereof gradually becomes deeper from the rear end surface of the reaming portion toward the rear side in a rotating direction of the digging bit.

7. The digging bit according to claim 2, wherein the communication groove is configured so that a groove depth thereof gradually becomes deeper from the rear end surface of the reaming portion toward the rear side in a rotating direction of the digging bit.

8. The digging bit according to claim 1, wherein the communication groove is configured so that a groove depth thereof gradually becomes deeper from the rear end surface of the reaming portion toward the rear side in a rotating direction of the digging bit.

9. The digging bit according to claim 1, wherein the communication groove extends in a direction tilting to the rotational axis.

10. The digging bit according to claim 9, wherein the communication groove tilts toward a front end side in a direction of the rotational axis so as to be oriented in the a rotating direction of the digging bit.

11. The digging bit according to claim 10, wherein a tilting angle formed by an intersecting ridgeline located between the communication groove and the outer peripheral surface of the reaming portion with respect to the rotational axis when the intersecting ridgeline is viewed from a radially outer peripheral side with respect to the rotational axis, is within a range of 25° to 70°.

12. The digging bit according to claim 9, wherein a tilting angle formed by an intersecting ridgeline located between the communication groove and the outer peripheral surface of the reaming portion with respect to the rotational axis when the intersecting ridgeline is viewed from a radially outer peripheral side with respect to the rotational axis, is within a range of 25° to 70°.

* * * * *